United States Patent [19]

Bilson et al.

[11] Patent Number: 4,793,581

[45] Date of Patent: Dec. 27, 1988

[54] LUMINAIRE FITTER BOLT BRACKET

[75] Inventors: Edward B. Bilson, Memphis; Immual Mills, Bartlett, both of Tenn.

[73] Assignee: FL Industries, Inc., Livingston, N.J.

[21] Appl. No.: 687,856

[22] Filed: Dec. 31, 1984

[51] Int. Cl.[4] ..... F21P 5/00

[52] U.S. Cl. ..... 248/230; 362/431; 362/396; 362/370

[58] Field of Search ..... 248/230, 218.4, 251, 248/300, 231.6; 362/431, 403, 145, 396, 368, 370

[56] References Cited

U.S. PATENT DOCUMENTS

| | | | |
|---|---|---|---|
| 3,018,081 | 1/1962 | Waldbauer | 362/431 |
| 3,071,683 | 1/1963 | Queale | 362/368 |
| 3,142,501 | 7/1964 | Clark | 362/396 |
| 3,233,094 | 2/1966 | Foulds | 362/396 |
| 3,297,864 | 1/1967 | Waldbauer | 362/368 |
| 3,385,258 | 5/1968 | Curtin | 362/431 |
| 4,167,033 | 9/1979 | Fletcher | 362/431 |
| 4,320,443 | 3/1982 | Zwillich | 362/368 |
| 4,426,676 | 1/1984 | Taylor | 362/431 |

FOREIGN PATENT DOCUMENTS 2422399 6/1975 Fed. Rep. of Germany ..... 362/431

*Primary Examiner*—J. Franklin Foss
*Assistant Examiner*—Robert A. Olson
*Attorney, Agent, or Firm*—Elliot M. Olstein; Raymond J. Lillie

[57] ABSTRACT

A fitter bolt bracket is provided for holding a luminaire to a luminaire support. The bracket comprises an elongated metal piece having a base section joining two raised edge sections, with the bracket having a channel shaped cross section. The raised edge sections each have a cut out portion, and the base section has two holes one near either end. The bracket holes are aligned with two laterally and longitudinally offset holes in the upper housing of the luminaire. The cut out portion of the raised edge section are axially aligned with a tubular luminaire support. The bracket is held to the upper housing by two bolts each one passing through one hole in the bracket and threading into the corresponding hole in the upper housing.

7 Claims, 3 Drawing Sheets

LUMINAIRE FITTER BOLT BRACKET

BACKGROUND OF THE INVENTION

The present invention relates to fitter bolt brackets and, more particularly, to a fitter bolt bracket adapted to join a luminaire to a luminaire support.

An outdoor luminaire used for streetlighting typically comprises an oblong metallic upper housing which includes the reflector, electric lamp and socket, ballast, capacitor and other items needed for the proper operation of the lamp. A bezel assembly is hinge mounted to the open lower face of the upper housing and can be securely closed against the upper housing. The bezel assembly includes a refractor element and a latch assembly for latching the bezel assembly closed against the upper housing. A luminaire support usually comprises a tubular or pipe like pole that extends into the luminaire and is secured to the upper housing. The method of securing the luminaire to the support should permit the luminaire to be leveled on the support. Further, as such installation is almost always accomplished in the field, it should be as simple and as rapid as possible.

A typical luminaire mounting assembly is shown in U.S. Pat. No. 4,426,676. A tubular luminaire support enters a luminaire housing. The support is held against the upper housing by a support bracket which contacts the support at two locations. The bracket is held to the upper housing by four bolts, which is typical of such supports, and which permits the leveling of the luminaire on the support. Because of the presence of four bolts, the installer must alternately tighten and loosen the front and rear bolts until the luminaire is leveled. This can be a time consuming and tedious process.

Accordingly, it is an object of the present invention to provide an improved luminaire fitter bolt bracket.

SUMMARY OF THE INVENTION

The present invention provides a luminaire fitter bolt bracket capable of joining a luminaire to a luminaire support tube by the use of only two bolts or similar fastening means.

The luminaire comprises an oblong, metallic upper housing wherein the ballast, capacitor, lamp socket, reflector and other necessary elements of the luminaire are located. A bezel assembly is hinge mounted at one end to an end of the upper housing. The bezel assembly includes a refractor element and a latch assembly whereby the bezel assembly can be closed against the open bottom face of the upper housing.

A tubular or pipe-like luminaire support extends into the upper housing through an opening at a rear end thereof. A receiving assembly in the upper housing includes three raised ribs each having a cut section therein to receive the tubular support. Of the three raised ribs, the center rib is higher then the ribs on either side. This is done so the luminaire support rides on the center rib between the bolts and can be rocker or leveled between the ribs on either side. The center rib has a V-shaped cut out so it can accept supports of different diameters. The outer ribs have circular section cut outs. All of the cut out sections are axially aligned with the longitudinal axis of the upper housing to assure that the tubular support is received in a squared manner in the upper housing. Another way of saying this is that the longitudinal axis of the luminaire support is aligned with the longitudinal axis of the upper housing. Two holes are present in the upper housing. These holes are adapted to receive bolts therein and accordingly may be threaded. Each hole is present in one of the raised ribs of the upper housing. The holes are on opposite sides of the longitudinal axis of the upper housing. Further, the holes are separated laterally on spaced lines normal to the longitudinal axis of the upper housing. Accordingly, the holes can be said to be longitudinally and laterally offset from each other.

A fitter bolt bracket holds the tubular luminaire support of the upper housing. A preferred configuration for the bracket is an elongated metal piece having a base section joining two raised ribs. Accordingly, the bracket has a channel shaped cross section. Each rib has a cut out section having curved sides or, preferably, two straight edge sides forming a V-shaped cut out. A hole is formed through the base section at each end thereof. When the bracket is placed in the upper housing, the holes in the bracket are aligned with the offset holes in the upper housing so that bolts may be inserted in the holes to hold the bracket to the housing. The cut out sections of the bracket are so aligned such that, when the bracket is installed in the offset holes in the upper housing, the cut out sections are aligned with the longitudinal axis of the upper housing. Accordingly, the cut out sections are able to receive the luminaire support tube and, when the bolts are tightened, to affix the support between the bracket and the upper housing due to the pressing of the cut out sections of the two raised ribs of the bracket against the support tube. The bracket itself is installed at an angle to the longitudinal axis of the upper housing. Such an installation of the bracket allows a sufficient anchoring of the bracket to the upper housing by the installation of two bolts, one on each side of the longitudinal axis of the upper housing. The luminaire is readily leveled by the appropriate tightening of the bolt on either side of the longitudinal axis of the upper housing.

In particular, the present invention provides a luminaire comprising an upper housing, a bezel housing hinged at one end to said upper housing, said bezel housing including a refractor mounted therein, and a fitter bolt bracket comprising a generally elongated metal piece having two holes one near either end thereof, said upper housing of said luminaire having two laterally and longitudinally offset openings near its hinge end, said openings in said upper housing adapted to receive bolts to secure said fitter bolt bracket thereto by aligning the openings in said base portion of said fitter bolt bracket with said upper housing openings thereby aligning said fitter bolt bracket to receive and secure a support for said luminaire between said fitter bolt bracket and said upper housing.

DESCRIPTION OF THE PREFERRED EMBODIMENT

Figure 1:
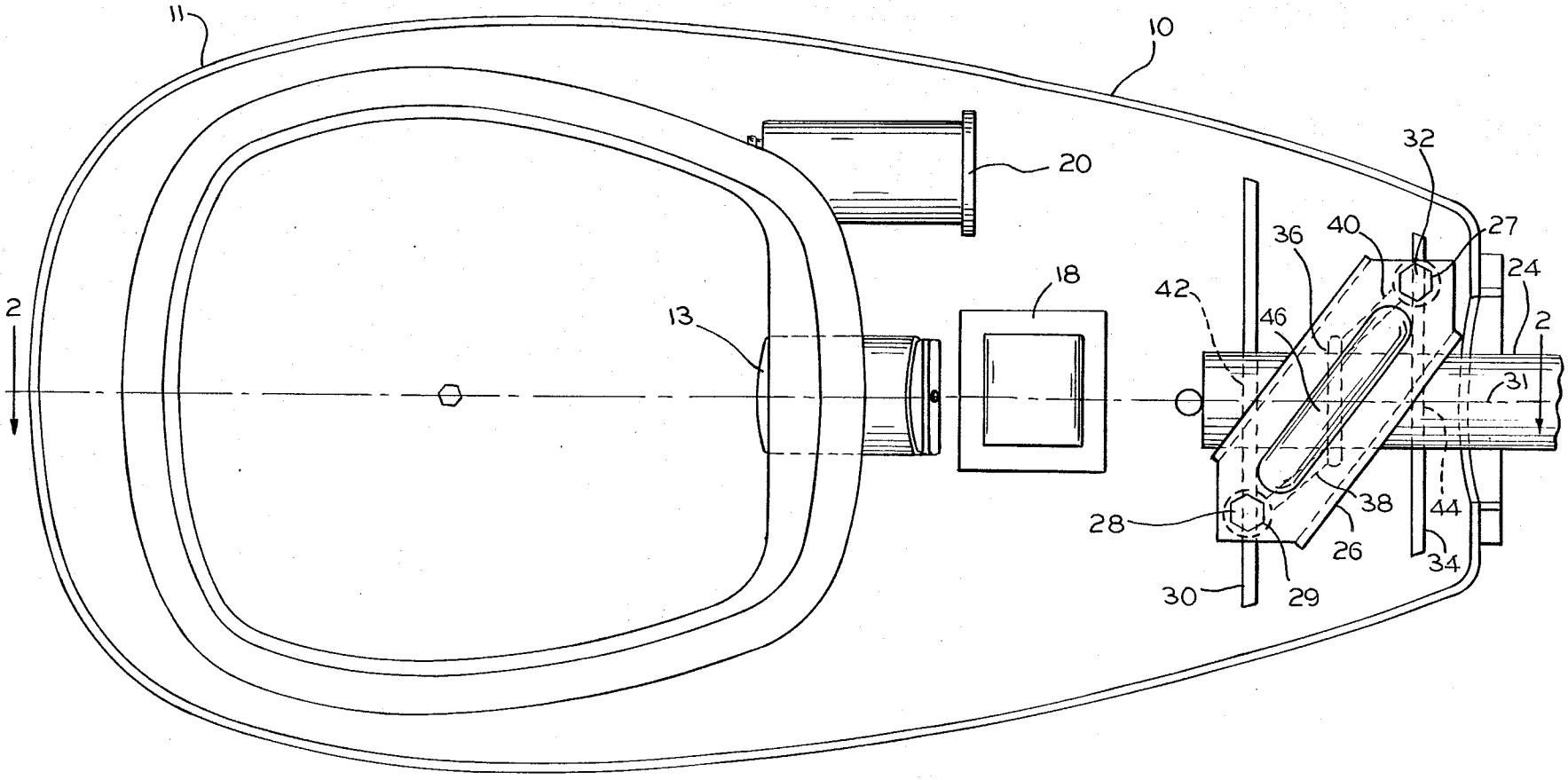
FIG. 1 is a bottom view with portions cut away of a luminaire upper housing, luminaire support and fitter bracket in accordance with the present invention.
Figure 2:
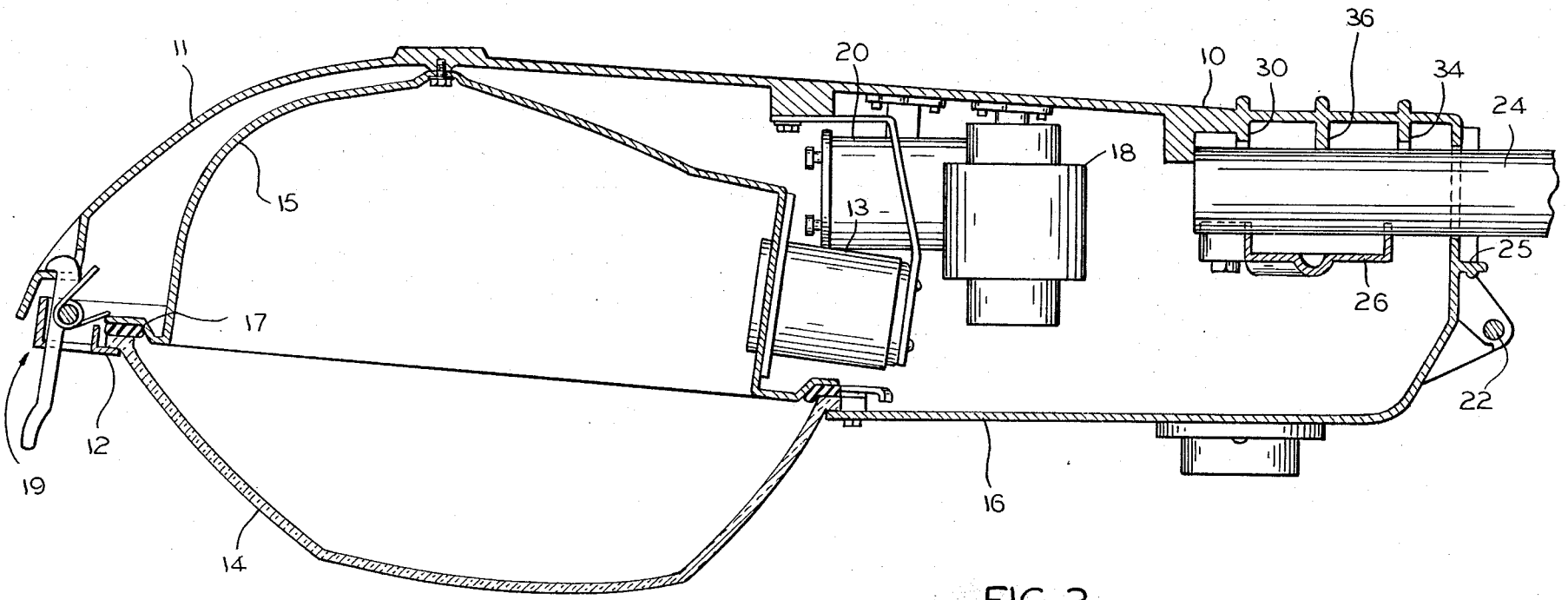
FIG. 2 is a cross sectional side view of a luminaire and luminaire support in accordance with the present invention.

Referring now to FIGS. 1 and 2 of the drawings, a luminaire is shown generally at 10 comprising an oblong upper housing 11. Reflector 15 and lamp socket 13 are mounted to upper housing 11. A bezel assembly 12 comprising refractor 14 is mounted by hinge 22 to housing 11 so that by operation of latch 18, bezel assembly 12 can be closed against gasket 17 on the open lower face of upper housing 11. Ballast 18 and capaciter 20 are mounted on the inside of upper housing 10.

Luminaire support tube 24 enters an opening 25 in the hinge end of upper housing 11. Rib 30 extends from the inner surface of upper housing 11 normal to the longitudinal axis 31 of upper housing 11 and includes opening 28. Another rib 34 extends from the inner surface of upper housing 11 and is parallel to but laterally spaced from rib 30 and includes opening 32 on the other side of longitudinal axis 31. Intermediate ribs 38, 40 extend from ribs 30, 34 to center rib 36. Center rib 36 extends further outward than ribs 30 or 34. Each of ribs 30, 34 and 36 have a cut out section 42, 44 and 46 respectively, aligned with longitudinal axis 31. Cut out section 46 in rib 36 is formed by cutting two straight sides to form a V-shaped notch therein. Ribs 30 and 34 have circular section cut outs 42 and 44.

Notches 42, 44 and 46 receive luminaire support tube 24 which enters opening 25 in upper housing 11. Bolt fitter bracket 26 has openings 50, 52 in its base section 48 which receives two bolts 29, 27 which are threaded into openings 28, 32 respectively, in upper housing 11. Such bolting holds bracket 26 to upper housing 11 and thereby mounts luminaire 10 to luminaire support 24.

Figure 3:
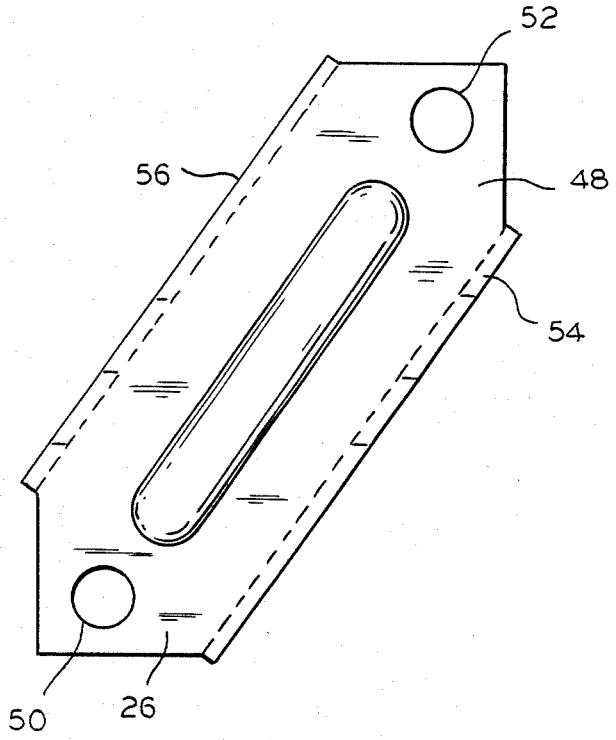
FIG. 3 is a top view of one embodiment of a fitter bracket in accordance with the present invention.
Figure 5:
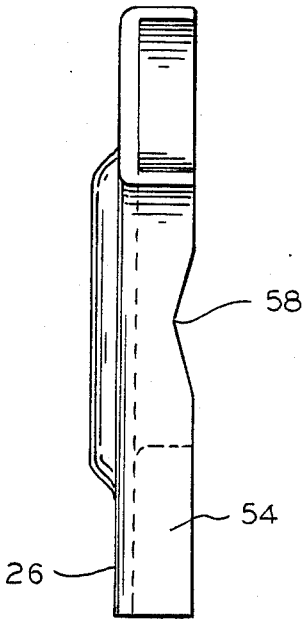
FIG. 5 is a side view of a fitter bracket in accordance with the present invention.
Figure 4:
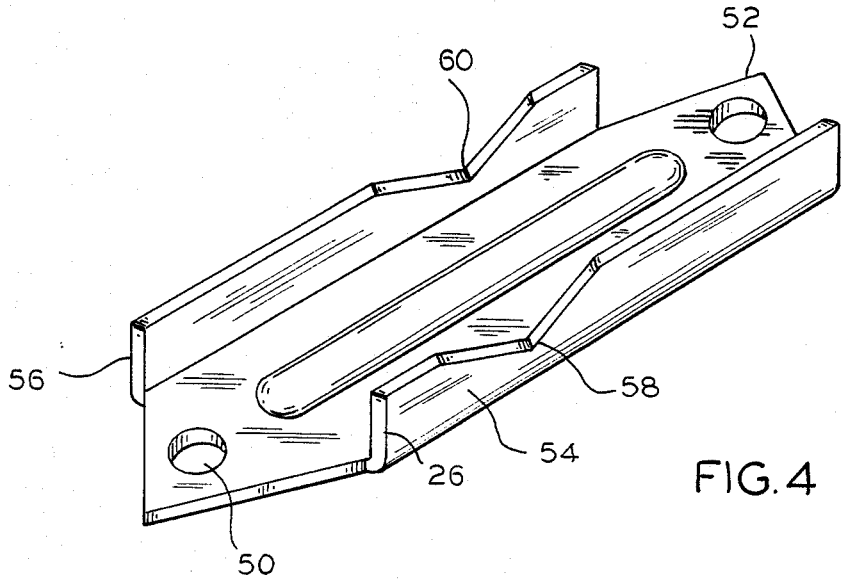
FIG. 4 is a perspective view of a fitter bracket in accordance with the present invention.

Referring now to FIGS. 3–5, bracket 26 is comprised of an elongated, generally flat base section 48 having openings 50 and 52 at either end. Base section 48 joins two raised ribs 54, 56 which form the edges of bracket 26. As best shown in FIG. 3, both openings 50 and 52 are located along the longitudinal axis of the bracket and substantially outside the straight ribs 54 and 56. Rib 54 has a notch 58 formed therein by two straight cut sections into and out of the raised edge of rib 54. Rib 56 has a notch 60 formed therein by two straight cut sections into and out of the raised edge of rib 56. Notches 58, 60 could also take the form of curved cut out sections if so desired. Notches 58, 60 are located in ribs 54, 56 such that when bracket 26 is bolted through openings 50, 52 onto longitudinally and laterally offset openings 28, 32 in upper housing 11, notches 58, 60 are aligned with the longitudinal axis 31 of upper housing 11. This is despite the angle at which bracket 26 is installed with respect to longitudinal axis 31. Such alignment of notches 58 and 60 assures that the longitudinal axis of luminaire support 24 will be aligned with longitudinal axis 31 of upper housing 11. By the tightening of bolts 29, 27 in openings 28, 32, luminaire 10 is firmly affixed to support 24 and can be readily leveled.

What is claimed is:

1. A luminaire comprising an upper housing, a bezel housing hinged at one end to said upper housing, said bezel housing including a refractor mounted therein, and a fitter bolt bracket having a generally elongated shape with two holes near either end thereof, said upper housing of said luminaire having two laterally and longitudinally offset openings near its hinge end, said openings in said upper housing matching said fitter bolt bracket holes; a luminaire support secured to said upper housing by said fitter bolt bracket; fastening means for connecting said bracket with said upper housing and passing through said openings and holes; said elongated bracket being sharply angled relative to said support;

said bracket having two raised straight ribs, each of said ribs including a cut out portion receiving said support;

said holes located along the longitudinal axis of said elongated bracket and substantially outside said ribs.

2. The luminaire of claim 1, wherein each of said cut out portions comprises an inclined notch having a first straight cut side and a second straight cut side.

3. The luminaire of claim 1, wherein said fitter bolt bracket, when bolted to said upper housing, is at an angle to the longitudinal axis of said upper housing and said luminaire support, while said cut out portions are axially aligned with the longitudinal axis of said upper housing and said luminaire support.

4. The luminaire of claim 1, wherein said upper housing includes three extending ribs having cut out sections receiving said luminaire support.

5. The luminaire of claim 1, wherein said two openings in said upper housing are positioned on opposite sides of the longitudinal axis of said upper housing and are spaced apart laterally on separate lines normal to the longitudinal axis of said upper housing.

6. A fitter bolt bracket for use in a luminaire including an upper housing and a luminaire support detachably secured thereto, said fitter bolt bracket comprising an elongated metal piece having a channel shaped cross section and having a base section joining two raised end sections, each of said raised end sections having a cut out portion abutting said luminaire support, said base section having two openings, one near either end thereof, said openings aligned with corresponding laterally and longitudinally offset openings in said upper housing; bolting means projecting through said openings in said base section into said openings in said upper housing and securing said fitter bolt bracket to said luminaire support; said elongated bracket being at a sharp angle to said upper housing;

said cut out portions being aligned with the longitudinal axis of said upper housing and said luminaire support;

said base section openings located substantially outside said raised end sections.

7. The fitter bolt bracket of claim 6, wherein said cut out portions of said raised end sections are each formed by two straight cut sections into said raised end section, with said cut out portions of said raised end section forming two edge surfaces contacting said luminaire support.

* * * * *